US010074946B2

(12) United States Patent
Cheng et al.

(10) Patent No.: US 10,074,946 B2
(45) Date of Patent: Sep. 11, 2018

(54) RECEPTACLE CONNECTOR AND ELECTRONIC DEVICE

(71) Applicant: HTC Corporation, Taoyuan County (TW)

(72) Inventors: Ying-Yen Cheng, Taoyuan County (TW); Wan-Hsieh Liu, Taoyuan County (TW); I-Cheng Chuang, Taoyuan County (TW); Hsin-Chih Liu, Taoyuan County (TW); Chih-Wei Tu, Taoyuan County (TW); Cheng-Lung Chang, Taoyuan County (TW); Chien-Ping Chen, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 1028 days.

(21) Appl. No.: 13/854,977

(22) Filed: Apr. 2, 2013

(65) Prior Publication Data

US 2014/0293555 A1 Oct. 2, 2014

(51) Int. Cl.
*H01R 24/58* (2011.01)
*H01R 12/71* (2011.01)

(52) U.S. Cl.
CPC ..... *H01R 24/58* (2013.01); *H01R 12/716* (2013.01)

(58) Field of Classification Search
CPC ..... H01R 12/716; H01R 24/58
USPC ..... 361/752
See application file for complete search history.

(56) References Cited

U.S. PATENT DOCUMENTS

| | | | | |
|---|---|---|---|---|
| 6,224,409 | B1 | 5/2001 | Chang | |
| 7,341,491 | B2 | 3/2008 | Zhu et al. | |
| 7,854,633 | B2 | 12/2010 | Lynch et al. | |
| 7,942,705 | B2 | 5/2011 | Murphy et al. | |
| 8,267,727 | B2 | 9/2012 | Lynch et al. | |
| 2009/0149081 | A1 | 6/2009 | Zhu et al. | |
| 2011/0059657 | A1* | 3/2011 | Lynch | 439/668 |
| 2011/0195611 | A1* | 8/2011 | Little | H01R 13/52 439/668 |
| 2012/0050151 | A1 | 3/2012 | Dabov et al. | |

(Continued)

FOREIGN PATENT DOCUMENTS

| | | |
|---|---|---|
| CN | 201340947 | 11/2009 |
| CN | 102570136 | 7/2012 |

OTHER PUBLICATIONS

"Office Action of China Counterpart Application", dated Nov. 10, 2015, p. 1-p. 9, in which the listed rreferences were cited.

*Primary Examiner* — Michael P McFadden
(74) *Attorney, Agent, or Firm* — JCIPRNET

(57) ABSTRACT

A receptacle connector adapted to be fixed to a casing of an electronic device and electrically connected to a circuit board for enabling the receptacle connector to be adapted to connect with a plug connector is provided. The receptacle connector includes an insulating body and a plurality of conductive terminals. The insulating body has a tunnel, and the tunnel extends from the outer side of the insulating body to the inner side of the insulating body, wherein a side of the tunnel is exposed at a top portion of the insulating body, and the insulating body is adapted to be fixed to the casing to cover the side of the tunnel, so that the tunnel is adapted to form a plug hole with the casing. The conductive terminals are disposed through the insulating body. A receptacle connector and an electronic device are also provided.

15 Claims, 8 Drawing Sheets

(56) References Cited

U.S. PATENT DOCUMENTS

| | | | | |
|---|---|---|---|---|
| 2012/0156907 | A1* | 6/2012 | Ladouceur ..... | H01R 13/639<br>439/131 |
| 2013/0070947 | A1 | 3/2013 | Chien et al. | |

* cited by examiner

RECEPTACLE CONNECTOR AND ELECTRONIC DEVICE

BACKGROUND

Field of the Application

The application relates to a connector and an electronic device, and more particularly, to a receptacle connector and an electronic device applied with the receptacle connector.

Description of Related Art

In recent years, along with the increasingly developments of the technology industry, electronic products such as mobile phones, tablet computer, notebook computer and smart phones become more and more popular. The electronic products are developing towards convenient usage, multi-functions and aesthetically pleasing design direction so as to provide users with more option selections.

In addition to the functions of electronic products themselves, the electronic product can also increase the use functions thereof by being connected to external devices. Therefore, these electronic products commonly employ connectors therein, so that the electronic products can connect to other external devices such as audio device or microphone (MIC) and further execute additional applications for playing music or recording. In this case, an electronic product is required to have a casing of a certain thickness, so that the connectors can be configured at the interior of the electronic product and connected to the external devices.

SUMMARY OF THE APPLICATION

The application provides a receptacle connector having a relatively thin thickness.

The application provides an electronic device having a relatively thin thickness.

The application provides a receptacle connector adapted to be fixed to a casing of an electronic device and electrically connected to a circuit board for enabling the receptacle connector to be adapted to connect with a plug connector. The receptacle connector includes an insulating body and a plurality of conductive terminals. The insulating body has a tunnel. The tunnel extends from the outer side of the insulating body to the inner side of the insulating body, wherein a side of the tunnel is exposed at a top portion of the insulating body, and the insulating body is adapted to be fixed to the casing to cover the side of the tunnel, so that the tunnel is adapted to form a plug hole with the casing. The conductive terminals are disposed at and pass through the insulating body.

The application further provides a receptacle connector adapted to be fixed to a casing of an electronic device and electrically connected to a circuit board for enabling the receptacle connector to be adapted to connect with a plug connector. The receptacle connector includes a first insulating body, a second insulating body and a plurality of conductive terminals. The first insulating body has a tunnel, and the tunnel extends from the outer side of the first insulating body to the inner side of the first insulating body, wherein a side of the tunnel is exposed at a top portion of the first insulating body. The second insulating body is adapted to be disposed on the casing, and the first insulating body is connected to the casing by connecting with the second insulating body so as to cover the side of the tunnel and form a plug hole. The conductive terminals are disposed at and pass through the first insulating body.

The application further provides an electronic device including a casing, a circuit board and a receptacle connector. The casing has an outward hole. The circuit board is disposed within the casing. The receptacle connector is fixed to the casing and electrically connected to the circuit board for enabling the receptacle connector to be adapted to connect with a plug connector. The receptacle connector includes a first insulating body, a second insulating body and a plurality of conductive terminals. The first insulating body has a tunnel, and the tunnel extends from the outer side of the first insulating body to the inner side of the first insulating body, wherein a side of the tunnel is exposed at a top portion of the first insulating body. The second insulating body is disposed on the casing, and the first insulating body is connected to the casing by connecting with the second insulating body, so as to cover the side of the tunnel and form a plug hole. The conductive terminals are disposed at and pass through the first insulating body.

According to the foregoing, a side of the tunnel of the first insulating body of the receptacle connector of the application is exposed at a top portion of the first insulating body, and the electronic device fixes the receptacle connector to the casing of the electronic device and electrically connects the receptacle connector to the circuit board, wherein the first insulating body of the receptacle connector is connected to the casing, so as to cover the side of the tunnel that is exposed at the first insulating body and form a plug hole. As such, the receptacle connector of the application has a relatively thin thickness for enabling the electronic device applied with the receptacle connector to have a relatively thin thickness.

In order to make the aforementioned and other features and advantages of the present application more comprehensible, several embodiments accompanied with figures are described in detail below.

BRIEF DESCRIPTION OF THE DRAWINGS

FIG. 6 is an assembly flow chart of the receptacle connector illustrated in

FIG. 4.

DETAILED DESCRIPTION OF DISCLOSED EMBODIMENTS

Figure 1:
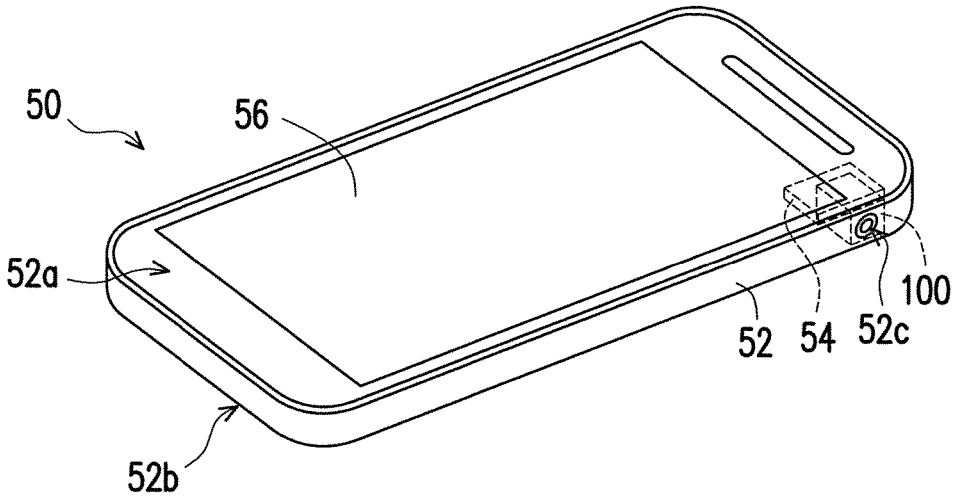
FIG. 1 is a schematic diagram illustrating an electronic device according to an embodiment of the application.

FIG. 1 is a schematic diagram illustrating an electronic device according to an embodiment of the application. FIG.

Figure 2:
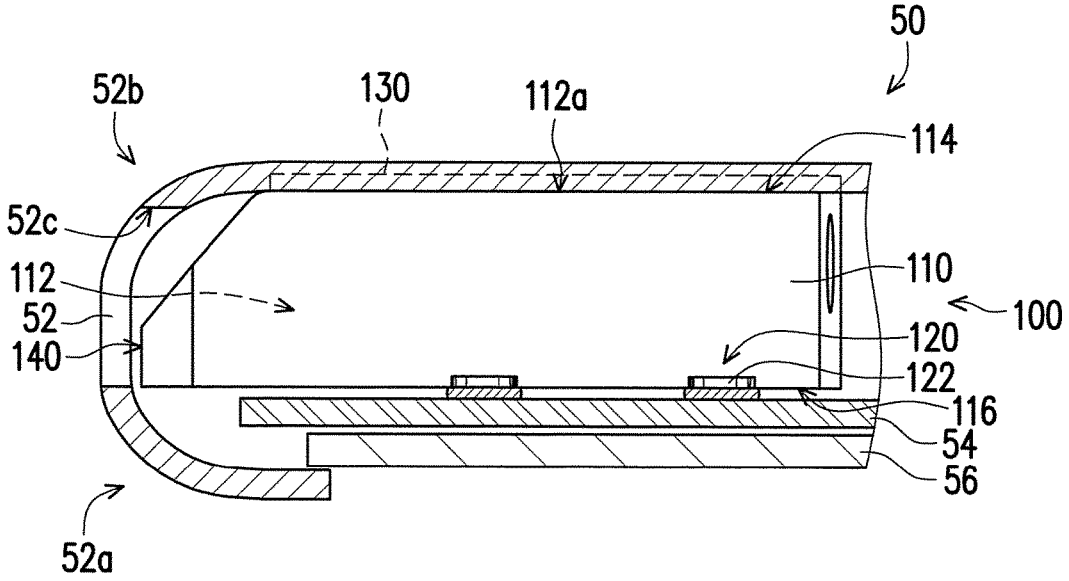
FIG. 2 is a side view of the electronic device illustrated in FIG. 1.

2 is a side view of the electronic device illustrated in FIG. 1. Referring to FIG. 1 and FIG. 2, in the present embodiment, an electronic device 50 includes a casing 52, a circuit board 54, a display panel 56 and a receptacle connector 100. The casing 52 has a front side 52*a* and a back side 52*b* opposite to the front side 52*a*, and the casing 52 has an outward hole 52*c*. The circuit board 54 is disposed within the casing 52. The display panel 56 is disposed at the front side 52*a* of the casing 52. The receptacle connector 100 is fixed to the casing 52 and electrically connected to the circuit board 54 for enabling the receptacle connector 100 to be adapted to connect with the plug-in connector (not shown) to connect to an external electronic device. The electronic device 50 is, for example, a smart phone, but the application is not intended to limit the type of the electronic device 50.

Figure 3:
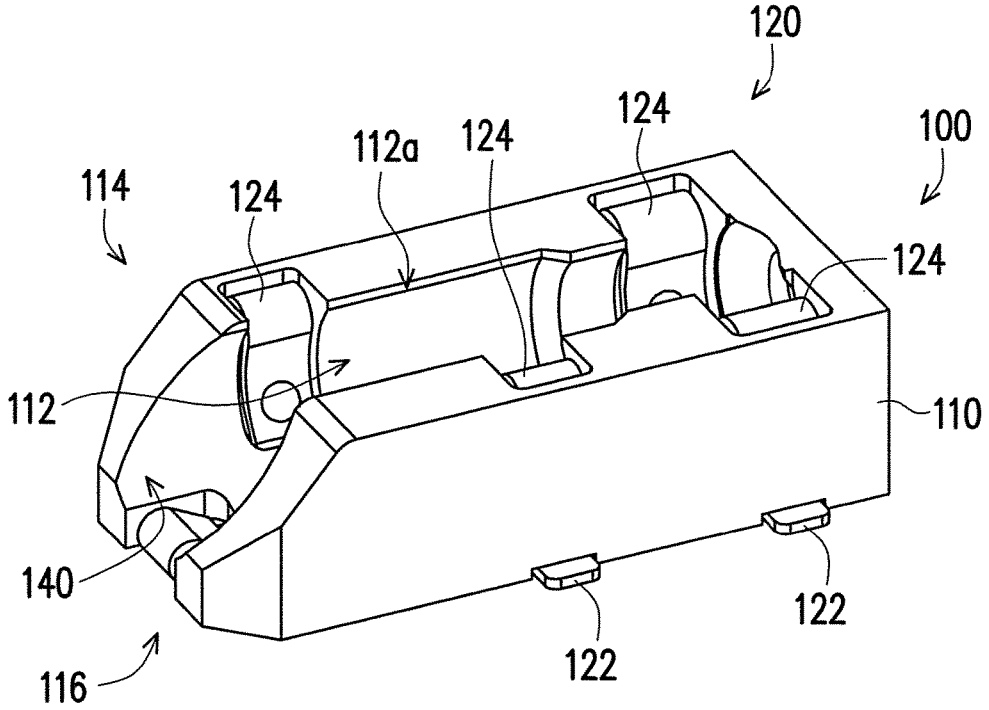
FIG. 3 is a perspective view of a receptacle connector illustrated in FIG. 2.

FIG. 3 is a perspective view of a receptacle connector illustrated in FIG. 2. Referring to FIG. 2 and FIG. 3, in the present embodiment, the receptacle connector 100 includes a first insulating body 110 and a plurality of conductive terminals 120. The receptacle connector 100 is, for example, an audio jack, but the application is not intended to limit the type of the receptacle connector 100. The receptacle connector 100 is adapted to be fixed to the casing 52 of the electronic device 50 and electrically connected to the circuit board 54 for enabling the receptacle connector 100 to be adapted to connect with the plug-in connector (not shown).

Specifically, in the present embodiment, the first insulating body 110 has a tunnel 112, and the first insulating body 110 has a top portion 114 and a bottom portion 116 opposite to the top portion 114. The tunnel 112 extends from the outer side of the first insulating body 110 to the inner side of the first insulating body 110, and a side of the tunnel 112 of the first insulating body 110 is, for example, a first side 112*a* of the tunnel 112, exposed at a top portion 114 of the first insulating body 110. The conductive terminals 120 are disposed at and pass through the first insulating body 110 and electrically connected to the circuit board 54.

In the present embodiment, the conductive terminals 120 are exposed at the bottom portion 116 of the first insulating body 110 and the tunnel 112. Parts of the conductive terminals 120 that expose at the bottom portion 116 can be electrically connected to the circuit board 54, and parts of the conductive terminals 120 that expose at the tunnel 112 are adapted to be in contact with the plug connector. Furthermore, each of the conductive terminals 120 has a soldering portion 122 and a contacting portion 124 connecting to the soldering portion 122. The soldering portion 122 is exposed at the bottom portion 116 of the first insulating body 110 and can be soldered at the circuit board 54 to be electrically connected to the circuit board 54, and the contacting portion 124 is located within the tunnel 112 and adapted to be in contact with the plug connector.

On the other hand, in the present embodiment, a side of the tunnel 112 of the first insulating body 110 of the receptacle connector 100 is, for example, the first side 112*a* of the tunnel 112, exposed at the top portion 114 of the first insulating body 110. Namely, as compared to a general insulating body of the receptacle connector, a thickness of the first insulating body 110 of the receptacle connector 100 is relative thin, such that the tunnel 112 is exposed at the top portion 114 of the first insulating body 110. Therefore, the receptacle connector 100 has a relatively thin thickness, and the electronic device 50 that disposes with the receptacle connector 100 may also reducing a thickness thereof.

Now, the first insulating body 110 of the receptacle connector 100 is fixed to the casing 52 that, for example, is located at a back cover (not shown) of the back side 52*b* of the casing 52 to cover the first side 112*a* of the tunnel 112 that is exposed at the first insulating body 110, so that the tunnel 112 and the casing 52 form a plug hole 140, and the conductive terminals 120 are adapted to contact with the plug connector, which is inserted from the plug hole 140 into the tunnel 112. The top portion 114 of the first insulating body 110 is, for example, fixed to the casing 52 via an ultrasonic welding, but in other embodiments, the top portion 114 of the first insulating body 110 may also be fixed to the casing 52 via glue or other means, and the application is not limited thereto.

Furthermore, in the present embodiment, the receptacle connector 100 also include a second insulating body 130. The second insulating body 130 is disposed on the casing 52, and the first insulating body 110 is connected to the casing 52 by being connected with the second insulating body 130. The second insulating body 130 may be integrally formed on the casing 52 that, for example, is located at the back cover (not shown) of the back side 52*b* of the casing 52, and the first insulating body 110 may be fixed to the casing 52 by being fixed to the second insulating body 130 via, for example, the ultrasonic welding, the glue or the other means, and the application is not intended to limit connecting methods of the first insulating body 110, the second insulating body 130 and the casing 52.

Accordingly, the first insulating body 110 is fixed to the casing 52 by being fixed to the second insulating body 130, so as to cover the first side 112*a* of the tunnel 112 that is exposed at the first insulating body 110 and form the plug hole 140. The plug hole 140 is located at the outer side of the receptacle connector 100 and corresponded to the outward hole 52*c*, such that the plug connector can be inserted into the receptacle connector 100 via the plug hole 140 located at the outer side of the receptacle connector 100, and enter the tunnel 112 to be electrically connected with the circuit board 54 by being in contact with the contacting portions 124 of the conductive terminals 120 that are exposed at the tunnel 112.

Therefore, when the plug connector is inserted into the tunnel 112 via the outward hole 52*c* and the plug hole 140, the first insulating body 110, through a fixing force of fixing to the casing 52, can avoid of generating a displacement with the second insulating body 130 or the casing 52 as the tunnel 112 is subjected to an inserting force of the plug connector, for example, avoiding both sides of the tunnel 112 from being pushed and expanded outward by the plug connector. In addition, when the plug connector is removed outwardly from the tunnel 112, the first insulating body 110, through the fixing force of fixing to the casing 52, can avoid of producing damages as the tunnel 112 is subjected to a pullout force of the plug connector.

Figure 4:
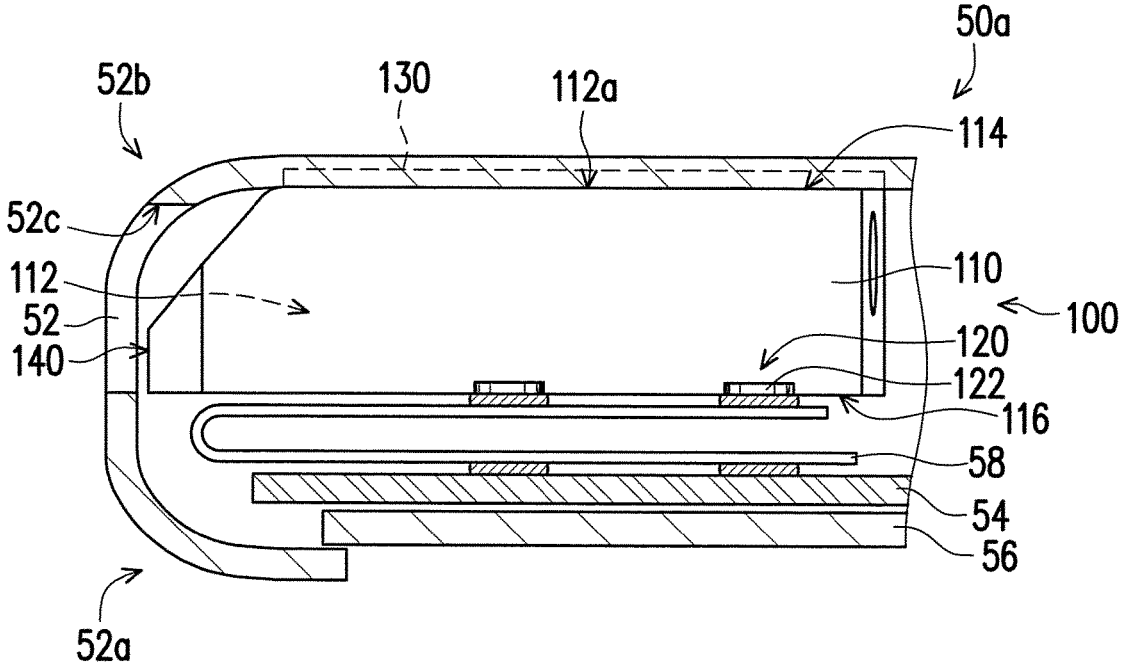
FIG. 4 is a side view illustrating an electronic device according to another embodiment of the application.

FIG. 4 is a side view illustrating an electronic device according to another embodiment of the application. Referring to FIG. 4, in the present embodiment, a main difference between an electronic device 50*a* and the electronic device 50 is that, the electronic device 50*a* further includes a flexible printed circuit 58. The flexible printed circuit 58 is disposed within the casing 52 and connected with the circuit board 54 and the receptacle connector 100, so that the conductive terminals 120 of the receptacle connector 100 are electrically connected to the circuit board 54 through the flexible printed circuit 58. Therefore, the receptacle connector 100 may firstly fix the first insulating body 110 to the second insulating body 130 on the casing 52 to cover the first side 112*a* of the tunnel 112 that is exposed at the first insulating body 110 and form the plug hole 140, solder the soldering portions 122 of the conductive terminals 120 to the flexible printed circuit 58, and electrically connect the flexible printed circuit 58 to the circuit board 54. Therefore, the flexible printed circuit 58 can be configured to adjust assembly tolerances between the casing 52, the circuit board 54 and the receptacle connector 100 of the electronic device 50*a*.

Figure 5:
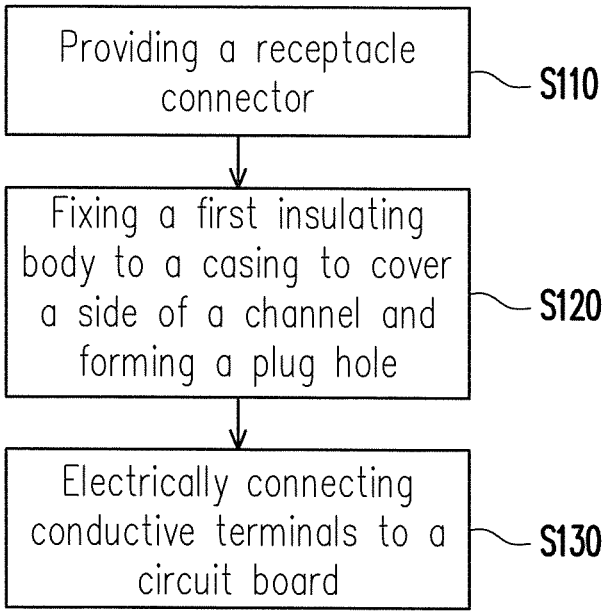
FIG. 5 is an assembly flow chart of the receptacle connector illustrated in FIG. 1.

FIG. 5 is an assembly flow chart of the receptacle connector illustrated in FIG. 1. Referring to FIG. 2, FIG. 3 and FIG. 5, in the present embodiment, an assembly method of the receptacle connector 100 includes the following steps. In step S110, the receptacle connector 100 is provided. In step S120, the first insulating body 110 is fixed to the casing 52 to cover a side of the tunnel 112 and form the plug hole 140. In step S130, the conductive terminals 120 are electrically connected to the circuit board 54. In the following below, each step is to be described.

Firstly, in the step S110, the receptacle connector 100 is provided. Referring to FIG. 2, FIG. 3 and FIG. 5, in the present embodiment, the first insulating body 110 of the receptacle connector 100 has the tunnel 112, and the tunnel 112 extends from the outer side of the first insulating body 110 to the inner side of the first insulating body 110. A side of the tunnel 112 is, for example, the first side 112*a* of the tunnel 112, exposed at the top portion 114 of the first insulating body 110, and the conductive terminals 120 of the receptacle connector 100 are disposed at and pass through the first insulating body 110. Therefore, the receptacle connector 100 has a relatively thin thickness.

Next, in the step S120, the first insulating body 110 is fixed to the casing 52 to cover a side of the tunnel 112 and form the plug hole 140. Referring to FIG. 2, FIG. 3 and FIG. 5, in the present embodiment, the first insulating body 110 is fixed to the casing 52 to cover the first side 112*a* of the tunnel 112, wherein the first insulating body 110 is, for example, fixed to the casing 52 via the ultrasonic welding. In addition, the first insulating body 110 may also be connected to the second insulating body 130 of the receptacle connector 100, wherein the second insulating body 130 is disposed on the casing 52, and is, for example, integrally formed with the casing 52. Therefore, the first insulating body 110 is connected to the casing 52 by being connected with the second insulating body 130, so as to cover the first side 112*a* of the tunnel 112 and form the plug hole 140.

Lastly, in the step S130, the conductive terminals 120 are electrically connected to the circuit board 54. Referring to FIG. 2, FIG. 3 and FIG. 5, in the present embodiment, a method of electrically connecting the conductive terminals 120 to the circuit board 54, for example, is to solder the soldering portion 122 to the circuit board 54. As such, the conductive terminals 120 can be electrically connected to the circuit board 54 so as to be adapted to contact the plug connector that is inserted from the plug hole 140 into the tunnel 112. In addition, in the present embodiment, orders of the step S120 and the step S130 may be interchanged. Specifically, this assembly method may firstly fix the first insulating body 110 to the casing 52 or connect the first insulating body 110 to the second insulating body 130 disposed on the casing 52 so as to cover the first side 112*a* of the tunnel 112, and then electrically connect the conductive terminals 120 to the circuit board 54; or it may also firstly electrically connect the conductive terminals 120 to the circuit board 54, and then fix the first insulating body 110 to the casing 52 or the second insulating body 130 to cover the first side 112*a* of the tunnel 112. Therefore, this assembly method may adjust the assembly order according to use demands, and the application is not limited thereto.

Figure 6:
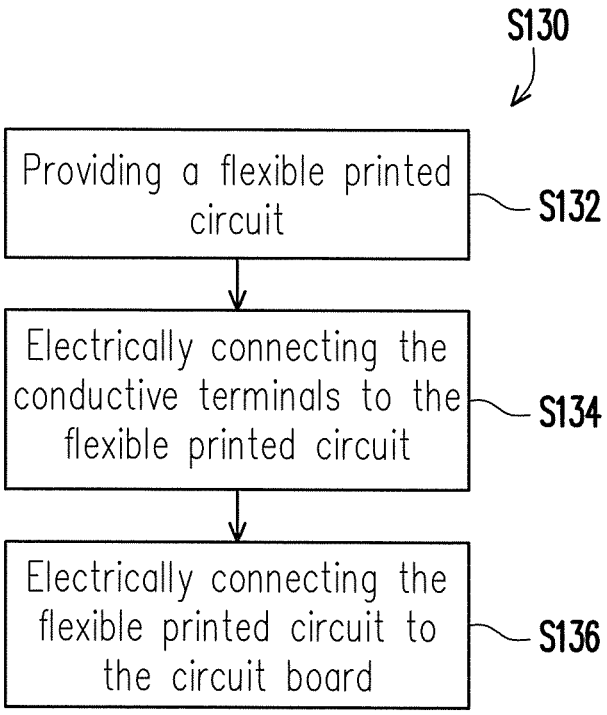

FIG. 6 is an assembly flow chart of the receptacle connector illustrated in FIG. 4. Referring to FIG. 4 and FIG. 6, in the present embodiment, the electronic device 50*a* further has the flexible printed circuit 58. Therefore, in the step 130 that electrically connects the conductive terminals 120 to the circuit board 54, it further includes the following steps. In step 132, the flexible printed circuit 58 is provided. In step 134, the conductive terminals 120 are electrically connected to the flexible printed circuit 58. In step 136, the flexible printed circuit 58 is electrically connected to the circuit board 54.

In the present embodiment, in the step 130 that electrically connects the conductive terminals 120 to the circuit board 54, the conductive terminals 120 can be electrically connected to the circuit board 54 through the flexible printed circuit 58, wherein the soldering portions 122 of the conductive terminals 120 are soldered to the flexible printed circuit 58, and the flexible printed circuit 58 is electrically connected to the circuit board 54. In addition, in the present embodiment, orders of the step S134 and the step S134 may be interchanged; namely, this assembly method may firstly electrically connect the conductive terminals 120 to the flexible printed circuit 58, and then electrically connect the flexible printed circuit 58 to the circuit board 54, or may also firstly electrically connect the flexible printed circuit 58 to the circuit board 54, and then electrically connect the conductive terminals 120 to the flexible printed circuit 58. This assembly method may adjust the assembly order according to the use demands, and the application is not limited thereto.

Figure 7:
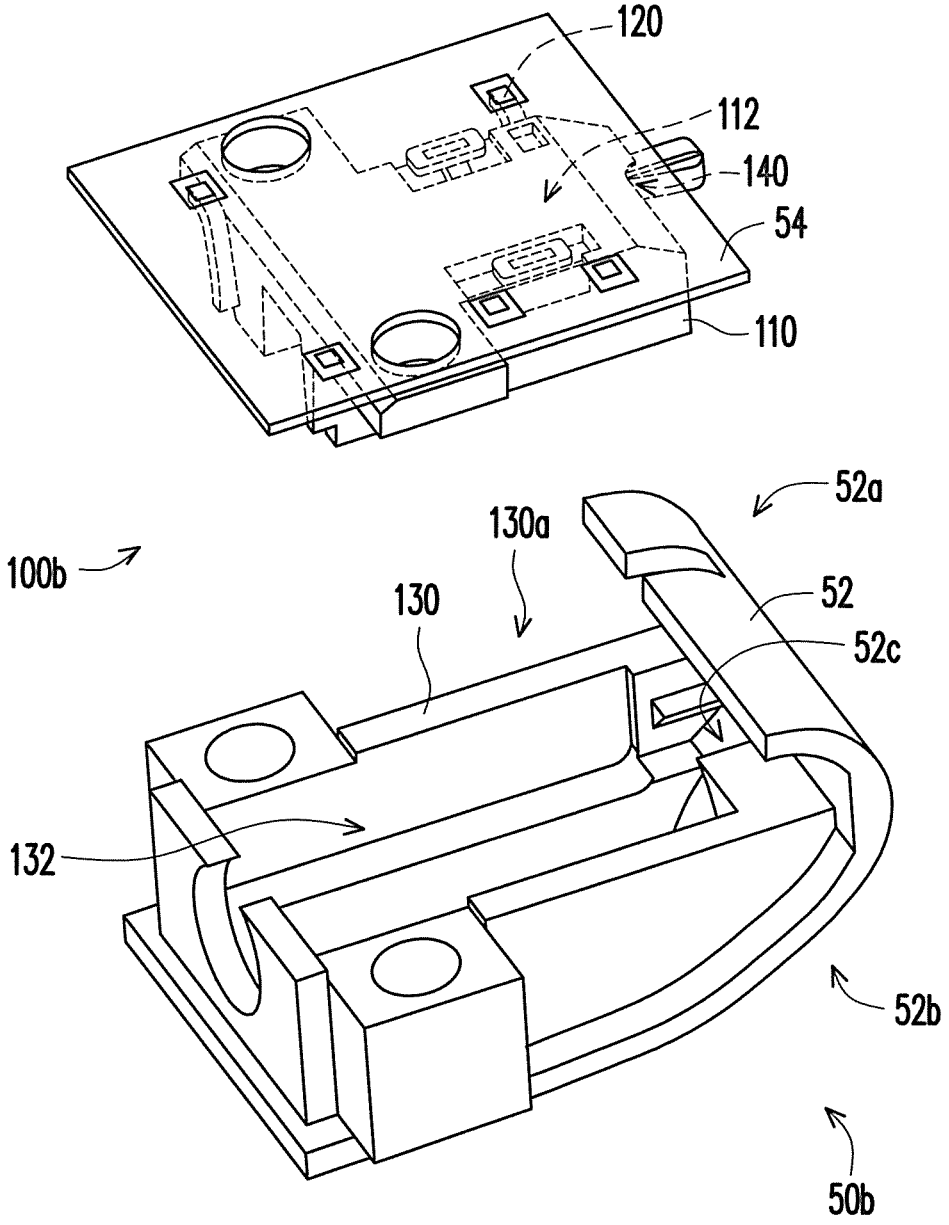
FIG. 7 is a partial exploded view illustrating an electronic device according to another embodiment of the application.
Figure 8:
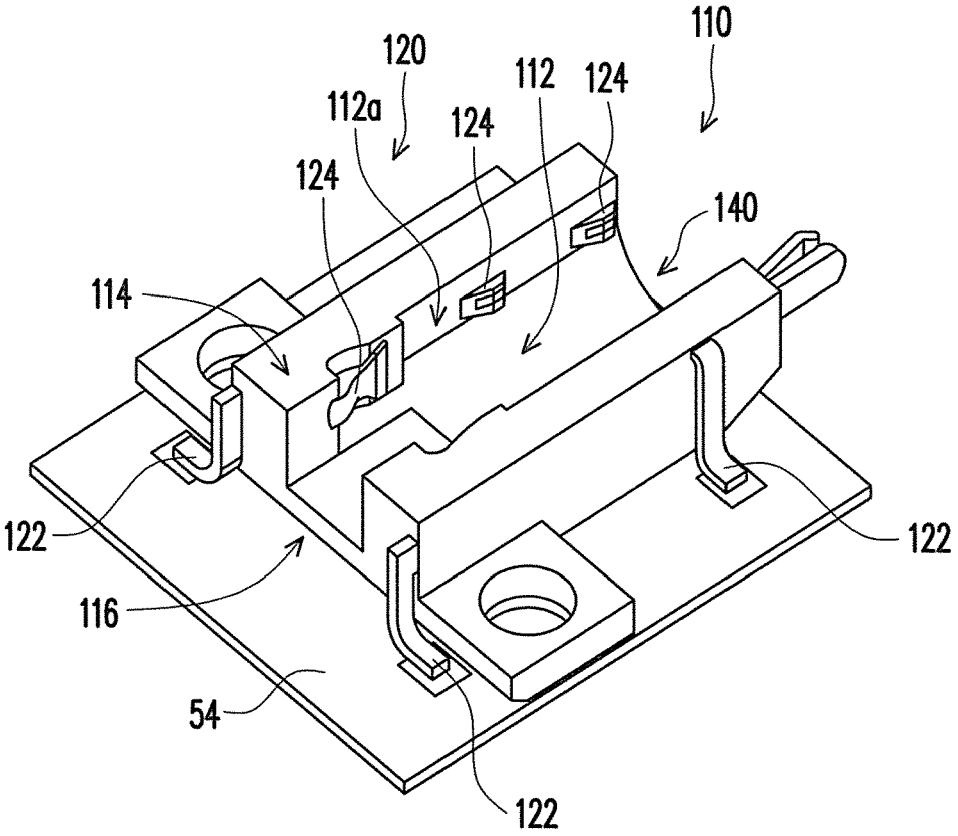
FIG. 8 is a perspective view of a first insulating body illustrated in FIG. 7.

FIG. 7 is a partial exploded view illustrating an electronic device according to another embodiment of the application. FIG. 8 is a perspective view of a first insulating body illustrated in FIG. 7. Referring to FIG. 7 and FIG. 8, in the present embodiment, an electronic device 50*b* includes the casing 52, the circuit board 54 and a receptacle connector 100*b*. The casing 52 has the front side 52*a*, the back side 52*b* and the outward hole 52*c*. The circuit board 54 is disposed within the casing 52. The receptacle connector 100*b* includes the first insulating body 110, the conductive terminals 120 and the second insulating body 130. The receptacle connector 100*b* is fixed to the casing 52 of the electronic device 50*b* and electrically connected to the circuit board 54 for enabling the receptacle connector 100*b* to be adapted to connect with a plug connector 60 (illustrated in FIG. 9).

In the present embodiment, the first insulating body 110 has the tunnel 112, and the first insulating body 110 has the top portion 114 and the bottom portion 116 opposite to the top portion 114. The tunnel 112 extends from the outer side of the first insulating body 110 to the inner side of the first insulating body 110, and a side of the tunnel 112 of the first insulating body 110 is, for example, the first side 112*a* of the tunnel 112, exposed at the top portion 114 of the first insulating body 110. Each of the conductive terminals 120 has the soldering portion 122 and the contacting portion 124 connected with the soldering portion 122. The conductive terminals 120 are disposed at and pass through the first insulating body 110 and exposed at the bottom portion 116 of the first insulating body 110 and the tunnel 112, wherein the soldering portions 122 are exposed at the bottom portion 116 of the first insulating body 110 and can be soldered at the circuit board 54, so as to be electrically connected to the circuit board 54, and the contacting portions 124 are located within the tunnel 112 and adapted to be in contact with the plug connector 60 (illustrated in FIG. 9).

Specifically, in the present embodiment, a side of the tunnel 112 of the receptacle connector 100*b* is, for example, the first side 112*a* of the tunnel 112, exposed at the top portion 114 of the first insulating body 110, such that the receptacle connector 100*b* has a relatively thin thickness, and the electronic device 50*b* disposed with the receptacle connector 100*b* may also reduce a thickness thereof. The second insulating body 130 of the receptacle connector 100*b* is disposed on the casing 52 and corresponded to the first insulating body 110. Furthermore, the second insulating body 130 may be integrally formed on the casing 52 that, for example, is located at the back cover (not shown) of the back side 52*b* of the casing 52, but the application is not limited thereto.

In the present embodiment, the second insulating body 130 disposed on the casing 52 has a fitting groove 132, and the first insulating body 110 is disposed on the second insulating body 130 by being assembled within the fitting groove 132, wherein the fitting groove 132 is disposed at a side of the second insulating body 130 which is, for example, the first side 130*a* of the second insulating body 130, the first insulating body 110 is assembled to the fitting groove 132 via the first side 130*a*, and the first insulating body 110 assembled to the fitting groove 132 may be fixed on the second insulating body 130 via locking, glue or other means. Therefore, the first insulating body 110 is fixed to the casing 52 by being fixed to the second insulating body 130, so as to cover the first side 112*a* of the tunnel 112 and form the plug hole 140. The plug hole 140 is located at the outer side of the receptacle connector 100*b* and corresponded to the outward hole 52*c*, such that the plug connector 60 can be inserted into the receptacle connector 100*b* via the plug hole 140 located at the outer side of the receptacle connector 100*b*, and then enter into the tunnel 112 to electrically connect with the circuit board 54 through the contacting portions 124 of the conductive terminals 120 that are exposed at the tunnel 112.

Figure 9:
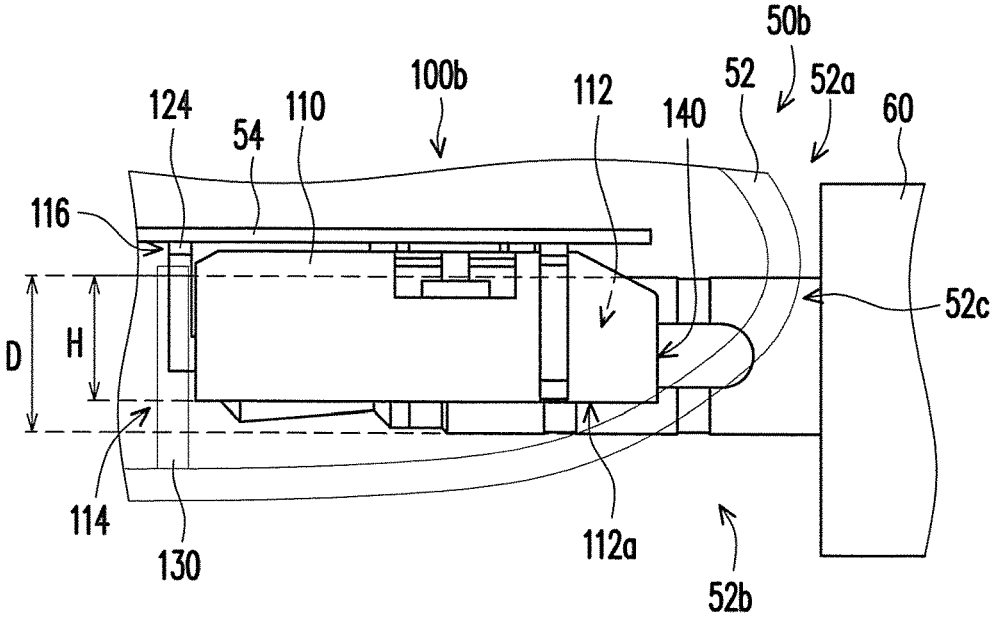
FIG. 9 is a side view of the electronic device illustrated in FIG. 7.

FIG. 9 is a side view of the electronic device illustrated in FIG. 7. Referring to FIG. 7 through FIG. 9, in the present embodiment, the conductive terminals 120 of the receptacle connector 100*b* are electrically connected to the circuit board 54 and adapted to be inserted from the plug hole 140 into the plug connector 60 within the tunnel 112, so that the receptacle connector 100*b* is adapted to be connected with other external electronic device by connecting with the plug connector 60. In addition, the first side 112*a* of the tunnel 112 is exposed at the first insulating body 110, so that a height H of the tunnel 112 is smaller than a diameter D of the plug connector 60. Therefore, when the plug connector 60 is inserted into the tunnel 112 from the outward hole 52*c* and the plug hole 140, a portion of the plug connector 60 is exposed at the first insulating body 110 from the top portion 114 of the first insulating body 110.

Now, since the top portion 114 of the first insulating body 110 of the receptacle connector 100*b* is fixed to the second insulating body 130 disposed at the casing 52 to cover the first side 112*a* of the tunnel 112 and form the plug hole 140, the first insulating body 110, through a fixing force of fixing to the second insulating body 130, can avoid of generating a displacement with the second insulating body 130 as the tunnel 112 is subjected to an inserting force of the plug connector 60, for example, avoiding both sides of the tunnel 112 from being pushed by the plug connector 60 and then expanding outward. In addition, when the plug connector 60 is removed outwardly of the tunnel 112, the first insulating body 110 can avoid of producing damages as the tunnel 112 is subjected to a pullout force of the plug connector 60 through the fixing force of fixing to the second insulating body 130.

Figure 10:
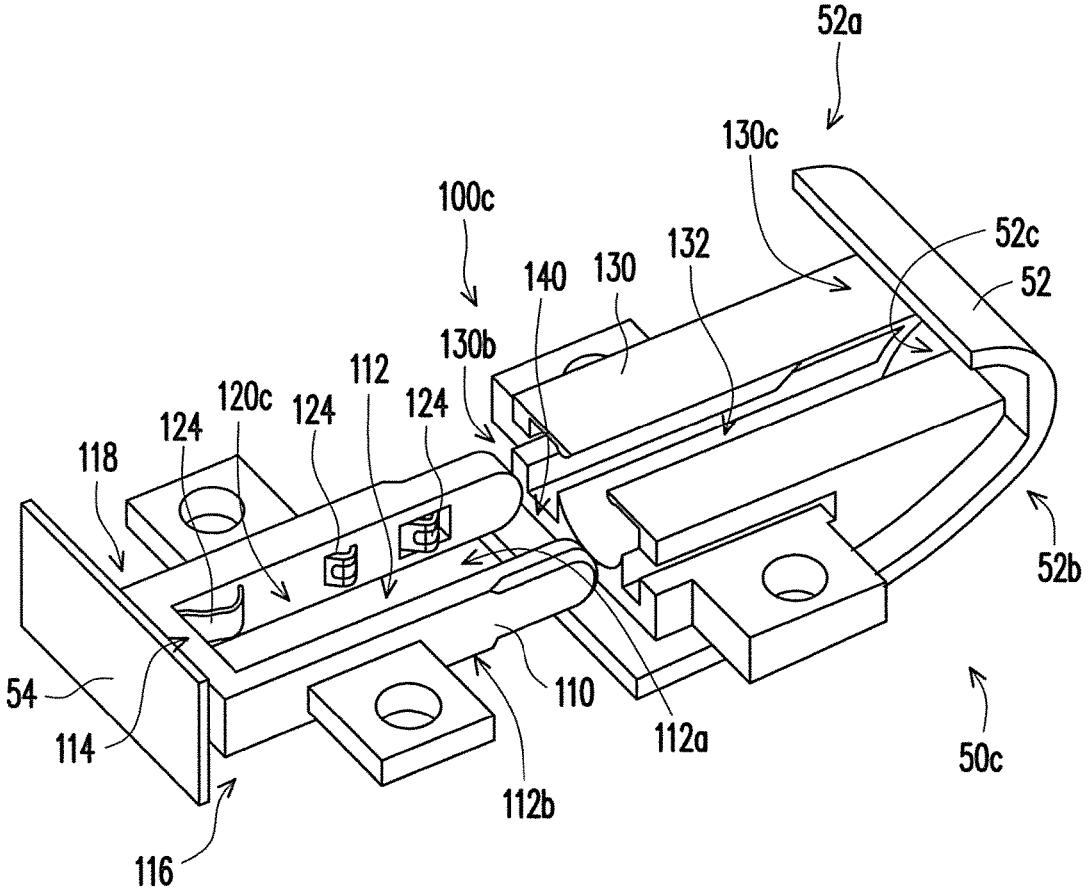
FIG. 10 is a partial exploded view illustrating an electronic device according to yet another embodiment of the application.
Figure 11:
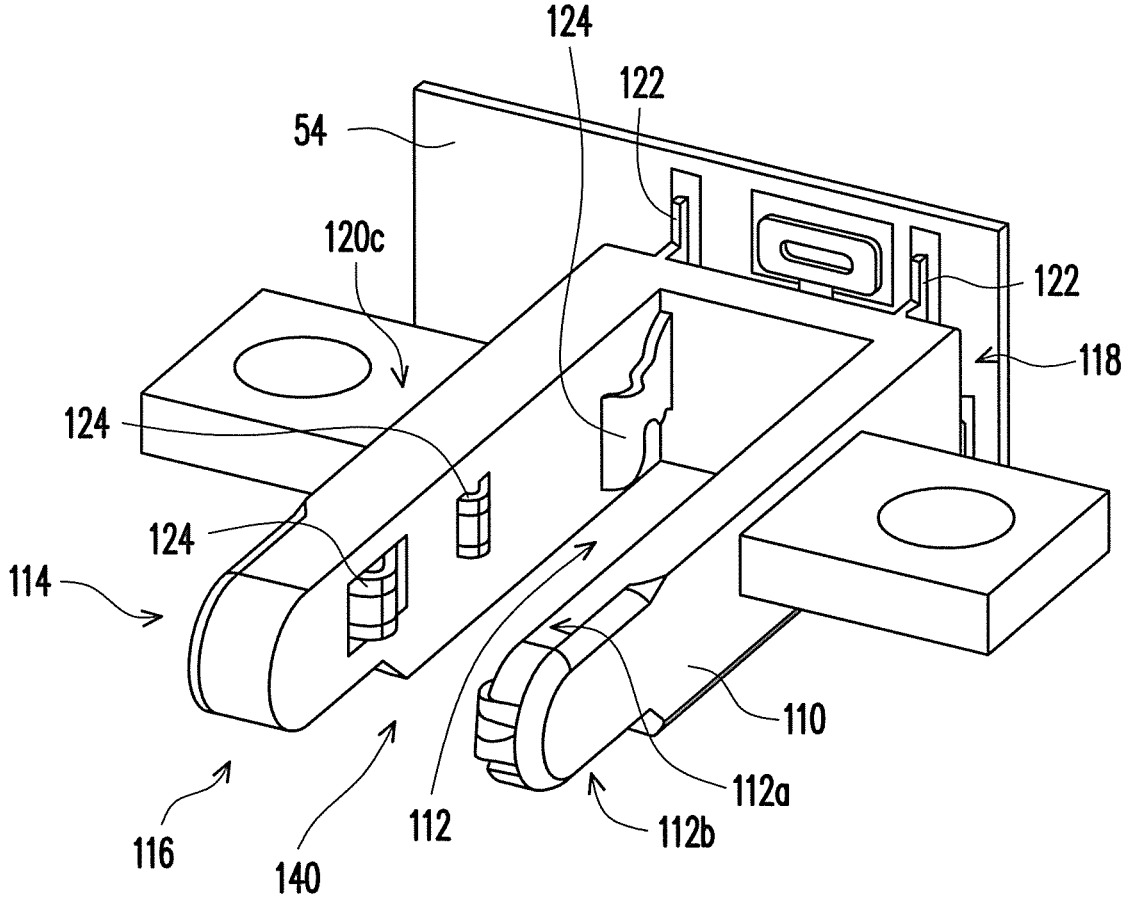
FIG. 11 is a perspective view of a first insulating body illustrated in FIG. 10.

FIG. 10 is a partial exploded view illustrating an electronic device according to yet another embodiment of the application. FIG. 11 is a perspective view of a first insulating body illustrated in FIG. 10. Referring to FIG. 10 and FIG. 11, in the present embodiment, an electronic device 50*c* includes the casing 52, the circuit board 54 and a receptacle connector 100*c*. The casing 52 has the front side 52*a* and the back side 52*b* opposite to the front side 52*a*, and the casing 52 has the outward hole 52*c*. The circuit board 54 is disposed within the casing 52. The receptacle connector 100*c* includes the first insulating body 110, a plurality of conductive terminals 120*c* and the second insulating body 130. The receptacle connector 100*c* are fixed to the casing 52 of the electronic device 50*c* and electrically connected to the circuit board 54 for enabling the receptacle connector 100*c* to be adapted to connect with the plug connector 60 (illustrated in FIG. 12).

In the present embodiment, the first insulating body 110 has the tunnel 112, and the first insulating body 110 has the top portion 114 and the bottom portion 116 opposite to the top portion 114. The tunnel 112 extends from the outer side of the first insulating body 110 to the inner side of the first insulating body 110, and a side of the tunnel 112 of the first insulating body 110 is, for example, the first side 112*a* and the second side 112*b* of the tunnel 112, which are respectively exposed at the top portion 114 of the first insulating body 110 and the bottom portion 116. Each of the conductive terminals 120*c* has the soldering portion 122 and the contacting portion 124 connected with the soldering portion 122. The conductive terminals 120*c* are disposed at and pass through the first insulating body 110, wherein the soldering portions 122 are exposed at a rear portion 118 of the first insulating body 110 that is opposite to the plug hole 140 and soldered at the circuit board 54, so as to be electrically connected to the circuit board 54, and the contacting portions 124 are located within the tunnel 112 and adapted to be connected with the plug connector 60 (illustrated in FIG. 12).

Specifically, in the present embodiment, a side of the tunnel 112 of the receptacle connector 100*c* is, for example, the first side 112*a* and the second side 112*b* of the tunnel 112, which are respectively exposed at the top portion 114 and the bottom portion 116 of the first insulating body 110, such that the receptacle connector 100*c* has a relatively thin thickness, and the electronic device 50*c* disposed with the receptacle connector 100*c* may also reduce a thickness thereof. Moreover, since the first side 112*a* and the second side 112*b* of the tunnel 112 are respectively exposed at the top portion 114 and the bottom portion 116 of the first insulating body 110, such that the circuit board 54 is unable to be disposed near to the top portion 114 and the bottom portion 116 of the first insulating body 110, so as not to interfere the plug connector 60 from being inserted into the tunnel 112. Therefore, the circuit board 54 has to be disposed at the rear portion 118 of the first insulating body 110, and the soldering portion 122 is soldered at the circuit board 54 by extending to the rear portion 118 of the first insulating body 11. Now, the second insulating body 130 of the receptacle connector 100*c* is disposed on the casing 52 and corresponded to the first insulating body 110. Furthermore, the second insulating body 130 may be integrally formed on the casing 52, but the application is not limited thereto.

In the present embodiment, the second insulating body 130 disposed on the casing 52 has the fitting groove 132, and the first insulating body 110 is disposed on the second insulating body 130 by being assembled within the fitting groove 132, wherein the fitting groove 132 is dispose at the inner side of the second insulating body 130 and penetrates through two opposite sides of the second insulating body 130 which are, for example, a second side 130*b* and a third side 130*c* of the second insulating body 130, and the first insulating body 110 is assembled to the fitting groove 132 via the inner side of the second insulating body 130 that, for example, penetrates into the fitting groove 132 from the second side 130*b* to the third side 130*c* of the second insulating body 130. As such, the fitting groove 132 and the first insulating body 110 may be interfered through shapes; for example, the first insulating body 110 may be fitted into the fitting groove 132 by being inserted into the fitting groove 132 to increase the fixing force between the two, and the first insulating body 110 assembled to the fitting groove 132 may be fixedly connected onto the second insulating body 130 via locking, glue or other means. Therefore, the first insulating body 110 is fixed to the casing 52 by being fixed to the second insulating body 130, so as to cover the first side 112*a* and the second side 112*b* of the tunnel 112 and to form the plug hole 140. The plug hole 140 is located at the outer side of the receptacle connector 100*c* and corresponded to the outward hole 52*c*, such that the plug connector can be inserted into the receptacle connector 100*c* through the plug hole 140 located at the outer side of the receptacle connector 100*c*, and enter into the tunnel 112 to be electrically connected with the circuit board 54 by being in contact with the contacting portions 124 of the conductive terminals 120*c* that are exposed at the tunnel 112.

Different from the previous embodiment, the first insulating body 110 and the second insulating body 130 of the receptacle connector 100*b* of the previous embodiment are vertically connected, such that the first insulating body 110 can be disposed on the second insulating body 130 through the top portion 114, so as to cover the first side 112*a* of the tunnel 112 that is exposed at the top portion 114 and form the plug hole 140. Nevertheless, the first insulating body 110 and the second insulating body 130 of the receptacle connector 100*c* of the present embodiment are horizontally connected, wherein the first insulating body 110 is assembled within the fitting groove 132 through inserting one end thereof into the fitting groove 132, such that the first insulating body 110 can cover the first side 112*a* and the second side 112*b* of the tunnel 112 that are exposed at the top portion 114 and the bottom portion 116 and form the plug hole 140 while being disposed on the second insulating body 130 through the top portion 114 and the bottom portion 116. Nevertheless, the application is not intended to limit the assembly method between the first insulating body 110 and the fitting groove 132 of the second insulating body 130.

Figure 12:
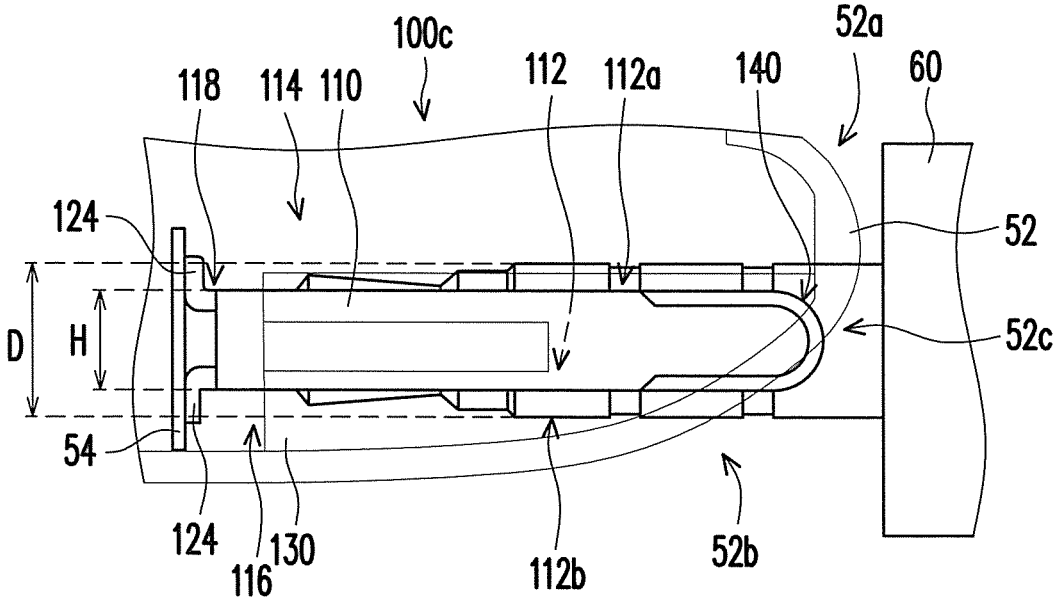
FIG. 12 is a side view of the electronic device illustrated in FIG. 10.

FIG. 12 is a side view of the electronic device illustrated in FIG. 10. Referring to FIG. 10 through FIG. 12, in the present embodiment, the receptacle connector 100*c* is adapted to be connected to other external electronic device by connecting with the plug connector 60. Now, the first side 112*a* and the second side 112*b* of the tunnel 112 are exposed at the top portion 114 and the bottom portion 116 of the first insulating body 110, such that the height H of the tunnel 112 is smaller than the diameter D of the plug connector 60. Therefore, when the plug connector 60 is inserted from the outward hole 52*c* and the plug hole 140 into the tunnel 112, a portion of the plug connector 60 is exposed at the first insulating body 110 from the top portion 114 and the bottom portion 116 of the first insulating body 110. However, in other embodiments, the first insulating body 110 may be configured with a tunnel 112 of a higher height, so that only a portion of the plug connector 60 is exposed at the first insulating body 110 from the top portion 114 or the bottom portion 116 of the first insulating body 110, and the application is not limited thereto.

Now, since the top portion 114 and the bottom portion 116 of the first insulating body 110 of the receptacle connector 100*c* is fixed to the second insulating body 130 disposed at the casing 52 to cover the first side 112*a* and the second side 112*b* of the tunnel 112 and form the plug hole 140, the first insulating body 110, through the fixing force of fixing to the second insulating body 130, can avoid of generating a displacement with the second insulating body 130 as the tunnel 112 is subjected to the inserting force of the plug connector 60, for example, avoiding both sides of the tunnel 112 from being pushed by the plug connector 60 and then expanding outward. In addition, when the plug connector 60 moves outward of the tunnel 112, the first insulating body 110, through the fixing force of fixing to the second insulating body 130, can avoid of producing damages as the tunnel 112 is subjected to the pullout force of the plug connector 60.

In summary, a side of the tunnel of the first insulating body of the receptacle connector of the application is exposed at the first insulating body, and the electronic device fixes the receptacle connector to the casing of the electronic device and electrically connects the receptacle connector to the circuit board, wherein the first insulating body of the receptacle connector is fixed to the casing so as to cover a side of the tunnel that is exposed at the first insulating body and form the plug hole, and the conductive terminals of the receptacle connector are disposed at and pass through the first insulating body and electrically connected to the circuit board. In addition, the conductive terminals of the receptacle connector may be electrically connected to the circuit board through the flexible printed circuit, so as to adjust the assembly tolerance of the electronic device. As such, the receptacle connector of the application is adapted to be connected with the plug connector and have a relatively thin thickness, so that the electronic device applied with the receptacle connector may have a relatively thin thickness.

It will be apparent to those skilled in the art that various modifications and variations can be made to the structure of the application without departing from the scope or spirit of the application. In view of the foregoing, it is intended that the application cover modifications and variations of this application provided they fall within the scope of the following claims and their equivalents.

What is claimed is:

1. A receptacle connector adapted to be fixed to a casing of an electronic device and electrically connected to a circuit board for enabling the receptacle connector to be adapted to connect with a plug connector, the receptacle connector comprising:

a first insulating body having a tunnel, the tunnel extending from the outer side of the first insulating body to the inner side of the first insulating body, wherein a side of the tunnel and an end of the tunnel are exposed at a top portion of the first insulating body;

a second insulating body directly fixed attach to the casing, the first insulating body attached to the casing by adhering with the second insulating body so as to cover the side of the tunnel and form a plug hole, wherein the second insulating body is integrally formed with the casing; and a plurality of conductive terminals disposed at and passing through the first insulating body.

2. The receptacle connector as recited in claim 1, wherein the conductive terminals are exposed at a bottom portion relative to the top portion of the first insulating body and the tunnel, parts of the conductive terminals that expose at the bottom portion are adapted to be electrically connected to the circuit board, and parts of the conductive terminals that expose at the tunnel are adapted to be in contact with the plug connector.

3. The receptacle connector as recited in claim 1, wherein the receptacle connector is adapted to be connected with the plug connector through inserting the plug connector into the tunnel, and a height of the tunnel is smaller than a diameter of the plug connector.

4. The receptacle connector as recited in claim 1, wherein the second insulating body has a fitting groove, and the first insulating body is disposed on the second insulating body by being assembled within the fitting groove.

5. An electronic device comprising:

a casing having an outward hole and a back cover;

a circuit board disposed within the casing; and a receptacle connector fixed to the casing and electrically connected to the circuit board for enabling the receptacle connector to be adapted to connect with a plug connector, the receptacle connector comprising:

a first insulating body having a tunnel, the tunnel extending from the outer side of the first insulating body to the inner side of the first insulating body, wherein a side of the tunnel and an end of the tunnel are exposed at a top portion of the first insulating body;

a second insulating body directly fixed attach to the casing, the first insulating body attached to the casing by adhering with the second insulating body so as to cover the side of the tunnel and form a plug hole, wherein the second insulating body is integrally formed with the casing; and a plurality of conductive terminals disposed at and passing through the first insulating body.

6. The electronic device as recited in claim 5, wherein the conductive terminals are electrically connected to the circuit board and adapted to contact the plug connector that is inserted from the plug hole into the tunnel.

7. The electronic device as recited in claim 5, wherein the conductive terminals are exposed at a bottom portion relative to the top portion of the first insulating body and the tunnel, parts of the conductive terminals that expose at the bottom portion are adapted to be electrically connected to the circuit board, and parts of the conductive terminals that expose at the tunnel are adapted to be in contact with the plug connector.

8. The electronic device as recited in claim 5, wherein the receptacle connector is adapted to be connected with the plug connector through inserting the plug connector into the tunnel, and a height of the tunnel is smaller than a diameter of the plug connector.

9. The electronic device as recited in claim 5, wherein the second insulating body has a fitting groove, and the first insulating body is disposed on the second insulating body by being assembled within the fitting groove.

10. The electronic device as recited in claim 5 further comprising:

a flexible printed circuit disposed within the casing and connected with the circuit board and the receptacle connector, so that the conductive terminals of the receptacle connector are electrically connected to the circuit board through the flexible printed circuit.

11. The electronic device as recited in claim 5, wherein the receptacle connector is an audio jack.

12. A receptacle connector adapted to be fixed to a casing of an electronic device and electrically connected to a circuit board for enabling the receptacle connector to be adapted to connect with a plug connector, the receptacle connector comprising:

a first insulating body having a tunnel, the tunnel extending from the outer side of the first insulating body to the inner side of the first insulating body, wherein a side of the tunnel and an end of the tunnel are exposed at a top portion of the first insulating body;

a second insulating body directly fixed attach to the casing, the first insulating body attached to the casing by adhering with the second insulating body so as to cover the side of the tunnel and form a plug hole, wherein the second insulating body is integrally formed with the casing, the second insulating body has a fitting groove, and the first insulating body is disposed on the second insulating body by being assembled within the fitting groove, and the fitting groove is disposed at a side of the second insulating body, and the first insulating body is assembled to the fitting groove via the side; and a plurality of conductive terminals disposed at and passing through the first insulating body.

13. A receptacle connector adapted to be fixed to a casing of an electronic device and electrically connected to a circuit board for enabling the receptacle connector to be adapted to connect with a plug connector, the receptacle connector comprising:

a first insulating body having a tunnel, the tunnel extending from the outer side of the first insulating body to the inner side of the first insulating body, wherein a side of the tunnel and an end of the tunnel are exposed at a top portion of the first insulating body;

a second insulating body directly fixed attach to the casing, the first insulating body attached to the casing by adhering with the second insulating body so as to cover the side of the tunnel and form a plug hole, wherein the second insulating body is integrally formed with the casing, the second insulating body has a fitting groove, and the first insulating body is disposed on the second insulating body by being assembled within the fitting groove, and the fitting groove is disposed at the inner side of the second insulating body and penetrates through the two opposite sides of the second insulating body, and the first insulating body is assembled to the fitting groove via the inner side of the second insulating body; and a plurality of conductive terminals disposed at and passing through the first insulating body.

14. An electronic device comprising:

a casing having an outward hole and a back cover;

a circuit board disposed within the casing; and a receptacle connector fixed to the casing and electrically connected to the circuit board for enabling the receptacle connector to be adapted to connect with a plug connector, the receptacle connector comprising:

a first insulating body having a tunnel, the tunnel extending from the outer side of the first insulating body to the inner side of the first insulating body, wherein a side of the tunnel and an end of the tunnel are exposed at a top portion of the first insulating body;

a second insulating body directly fixed attach to the casing, the first insulating body attached to the casing by adhering with the second insulating body, so as to cover the side of the tunnel and form the plug hole, wherein the second insulating body is integrally formed with the casing, the second insulating body has a fitting groove, and the first insulating body is disposed on the second insulating body by being assembled within the fitting groove, the fitting groove is disposed at a side of the second insulating body, and the first insulating body is assembled to the fitting groove via the side; and a plurality of conductive terminals disposed at and passing through the first insulating body.

15. An electronic device comprising:

a casing having an outward hole and a back cover;

a circuit board disposed within the casing; and a receptacle connector fixed to the casing and electrically connected to the circuit board for enabling the receptacle connector to be adapted to connect with a plug connector, the receptacle connector comprising:

a first insulating body having a tunnel, the tunnel extending from the outer side of the first insulating body to the inner side of the first insulating body, wherein a side of the tunnel and an end of the tunnel are exposed at a top portion of the first insulating body;

a second insulating body directly fixed attach to the casing, the first insulating body attached to the casing by adhering with the second insulating body, so as to cover the side of the tunnel and form the plug hole, wherein the second insulating body is integrally formed with the casing, the second insulating body has a fitting groove, and the first insulating body is disposed on the second insulating body by being assembled within the fitting groove, the fitting groove is disposed at the inner side of the second insulating body and penetrates through the two opposite sides of the second insulating body, and the first insulating body is assembled to the fitting groove via the inner side of the second insulating body; and a plurality of conductive terminals disposed at and passing through the first insulating body.

* * * * *